US005312115A

United States Patent [19]

Wu

[11] Patent Number: 5,312,115

[45] Date of Patent: May 17, 1994

[54] RACKET

[75] Inventor: Chao-I Wu, Taichung Hsien, Taiwan

[73] Assignee: Jan Feng Sports Products Corp., Taichung Hsien, Taiwan

[21] Appl. No.: 43,542

[22] Filed: Apr. 6, 1993

[51] Int. Cl.[5] ..... A63B 51/10

[52] U.S. Cl. ..... 273/73 D

[58] Field of Search ..... 273/73 R, 73 C, 73 D

[56] References Cited

U.S. PATENT DOCUMENTS

| | | | |
|---|---|---|---|
| 1,502,845 | 7/1924 | Blache | 273/73 D |
| 3,801,099 | 4/1974 | Lair | 273/73 D X |
| 3,986,716 | 10/1976 | Taussig et al. | 273/73 D X |
| 5,092,593 | 3/1992 | Williams | 273/73 C X |
| 5,192,072 | 3/1993 | Hong | 273/73 D X |
| 5,209,472 | 5/1993 | Tseng | 273/73 D X |

FOREIGN PATENT DOCUMENTS 4010722 10/1991 Fed. Rep. of Germany ... 273/73 D

*Primary Examiner*—William E. Stoll

*Attorney, Agent, or Firm*—Morton J. Rosenberg; David I. Klein

[57] ABSTRACT

A racket including a head and a handle joined by a racket throat, the head consisting of a network of catgut stretched in an oval open frame, and at least one protective covering covered on the oval open frame, each protective covering having pairs of opposite string holes arranged along two opposite longer sides thereof disposed within the oval open frame and equally spaced by gaps for threading a catgut in setting up the network of catgut.

7 Claims, 2 Drawing Sheets

RACKET

BACKGROUND OF THE INVENTION

The present invention relates to rackets and more particularly to an improved structure of racket which is easy to manufacture.

A normal racket generally consists of a network of catgut stretched in an oval open frame with a handle attached, and is used for striking the ball or shuttlecock in various games. The network of catgut is set up by threading a catgut through string holes on the oval open frame longitudinally latitudinally. Because the string holes should be disposed in different directions, it is difficult to drill string holes on the oval open frame. Another disadvantage of this structure of racket is that string grooves must be made on the outer wall of the oval open frame for passing the catgut so that the catgut does not protrude beyond the outside surface of the outer wall. Making the string grooves on the outer wall of the oval open frame is not easy, and a special molding is needed. Further, in order to protect the catgut from being damaged by the edge of the orifice at either end of either string hole, each string hole must be inserted with a protective hollow pin. Fastening protective hollow pins in the string holes complicates the manufacturing procedure of the racket.

SUMMARY OF THE INVENTION

The present invention eliminates the aforesaid drawbacks. It is therefore the principal object of the present invention to provide a racket which eliminates the procedure of drilling string holes on the oval open frame of the racket head. It is another object of the present invention to provide a racket which eliminates the procedure of forming string grooves on the outside wall of the oval open frame of the racket head. It is still another object of the present invention to provide a racket which eliminates the procedure of fastening string protective hollow pins to the oval open frame of the racket head.

According to the preferred embodiment, the racket consists of a head and a handle joined by a racket throat. The head comprises a network of catgut stretched in an oval open frame, and protective coverings covered on the oval open frame to hold the network of catgut within the oval open frame. Each protective covering has pairs of opposite string holes arranged along two opposite longer sides thereof and disposed within oval open frame and equally spaced by gaps for threading a catgut in setting up the network of catgut.

DETAILED DESCRIPTION OF THE PREFERRED EMBODIMENT

Figure 1:
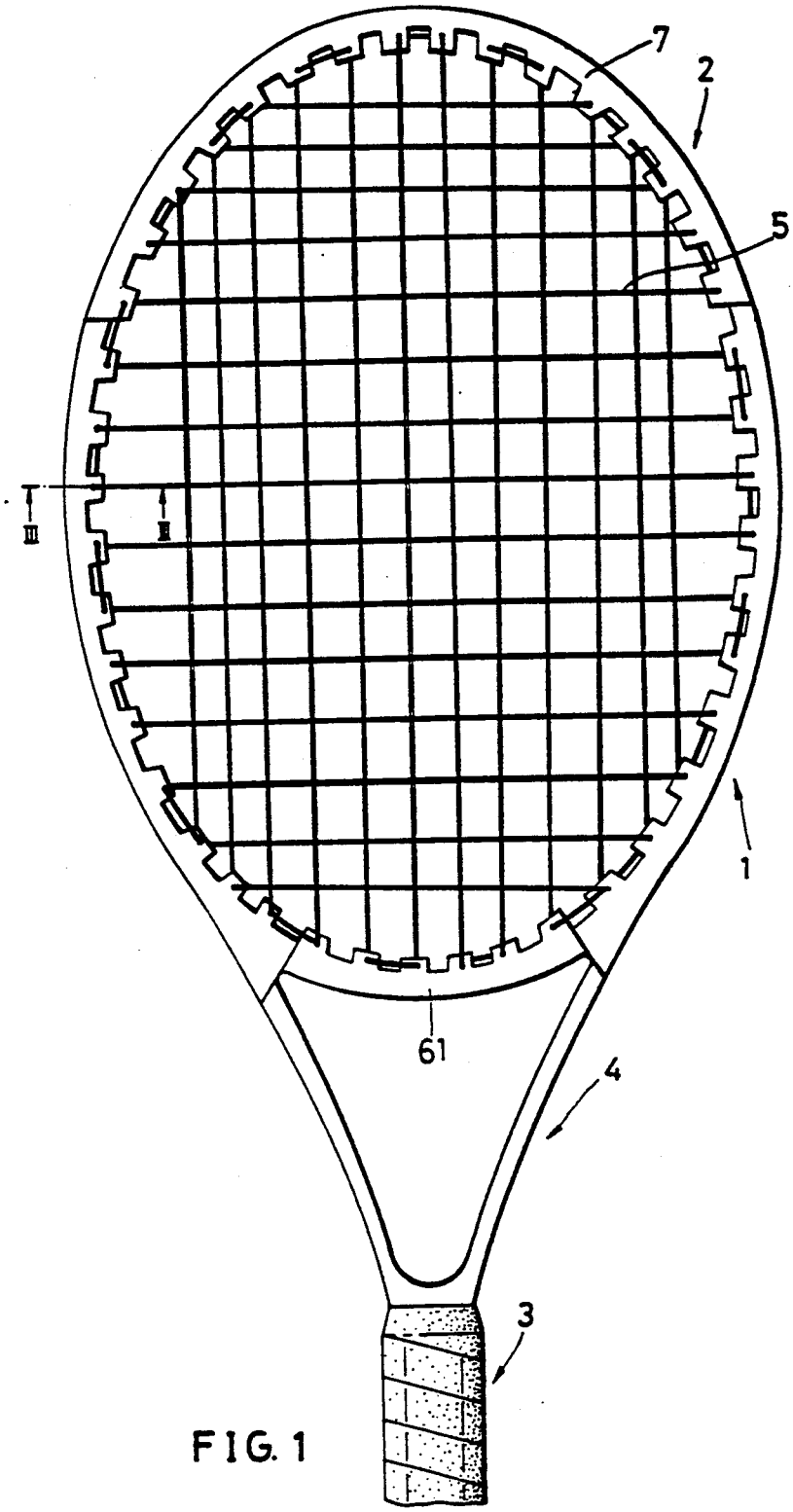
FIG. 1 is a perspective view of a racket embodying the present invention.
Figure 2:
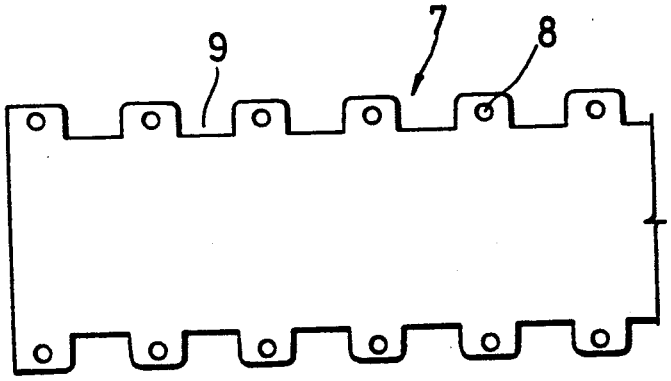
FIG. 2 is a rolled out view of a protective covering according to the present invention.
Figure 3:
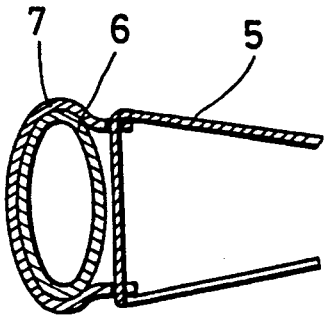
FIG. 3 is a cross section taken along line III—III of FIG. 1.

Referring to FIGS. 1, 2 and 3, a racket 1 in accordance with the present invention is generally comprised of a head 2 and a handle 3 joined by a racket throat 4. The handle 3 and the racket throat 4 are similar to the corresponding parts of the conventional rackets, and therefore they are not described in detail. The head 2 of the racket 1 is comprised of a network of catgut 5 stretched in an oval open frame 6, a throat bridge 61 connected between the racket throat 4, and protective coverings 7 covered on the frame 6 and the bridge 61. As illustrated in FIG. 2, the protective covering 7 comprises pairs of opposite string holes 8 arranged along two opposite longer sides thereof and equally spaced by gaps 9. The gaps 9 allow the protective covering 7 to be wrapped on the frame 6 or the bridge 61 smoothly without causing wrinkles. When covered on the frame 6 or the bridge 61, the pairs of opposite string holes 8 are respectively aligned for threading the catgut 5 in setting up a striking surface.

Figure 5:
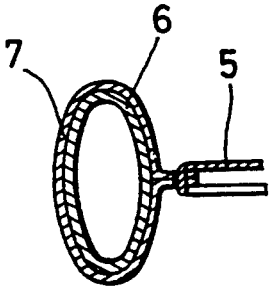
FIG. 5 is similar to FIG. 3 but showing another alternate form of the protective covering.
Figure 4:
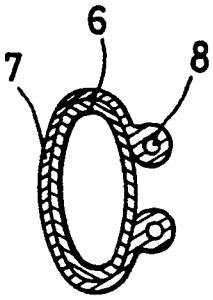
FIG. 4 is similar to FIG. 3 but showing an alternate form of the protective covering.

It shall be understood that the present invention is not limited to the embodiment shown by way of example and that deviations from this embodiment are possible without exceeding the scope of the invention. For example, openings may be made on the protective covering 7 to reduce its weight, the protective covering 7 may be made in any of a variety of cross sections as shown in FIGS. 4 and 5. In the alternate form of FIG. 5, the pair of opposite string holes are disposed in parallel.

What is claimed is:

1. A racket having a head section, a handle and a racket throat frame for coupling said handle to said head section, comprising:

(a) a closed contour head frame having a network of string elements extending in mutually orthogonal directions within said closed contour head frame;

(b) a first longitudinally extending flexible protective covering defining a plurality of pairs of transversely opposed flange sections having respective transversely aligned string holes formed therethrough, each of said pairs of said transversely opposed flange sections being longitudinally spaced apart from a next consecutive pair of said transversely opposed flange sections by a predetermined gap length, said first longitudinally extending flexible protective covering being formed around a cross-sectional wall section of said closed contour head frame for alignment of respective string holes of a respective pair of flanges, said flanges extending within said closed contour of said head frame for passing a string element through said aligned string holes, said string element passing therethrough being displaced from an inner wall of said closed contour head frame.

2. The racket as recited in claim 1 including a second longitudinally extending substantially flexible covering of substantially identical contour as said first flexible covering adapted to be formed around a lower section of said closed contour head frame.

3. The racket as recited in claim 1 where said first protective covering is formed around only a portion of said head frame wall section whereby said respective flanges are displaced from each other when said string element is passed through said respective aligned string holes.

4. The racket as recited in claim 1 where said first protective covering is formed around substantially an entire head frame wall section whereby said respective flanges are in contiguous relation each with respect to the other.

5. The racket as recited in claim 1 where said closed contour head frame includes an oval shape.

6. The racket as recited in claim 5 where said closed contour head frame includes an oval cross-sectional shape.

7. The racket as recited in claim 6 where said closed contour head frame is hollow forming an oval cross-sectionally shaped open chamber.

* * * * *